US007104856B1

(12) United States Patent
Krupp et al.

(10) Patent No.: US 7,104,856 B1
(45) Date of Patent: Sep. 12, 2006

(54) RIGGING APPARATUS FOR AN OUTBOARD MOTOR

(75) Inventors: Timothy D. Krupp, Fond du Lac, WI (US); Thomas J. Walczak, Oconomowoc, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/868,563

(22) Filed: Jun. 15, 2004

(51) Int. Cl.
*B63H 20/32* (2006.01)

(52) U.S. Cl. ..... 440/76; 440/77

(58) Field of Classification Search ..... 440/77; 174/65 G, 65 R; 285/154.2
See application file for complete search history.

(56) References Cited

U.S. PATENT DOCUMENTS 4,198,537 A * 4/1980 Mariani ..... 174/65 R
4,494,779 A * 1/1985 Neff et al. ..... 285/154.1
4,864,080 A * 9/1989 Fochler et al. ..... 174/65 G
4,969,847 A 11/1990 Curtis et al. ..... 440/77
5,285,013 A * 2/1994 Schnell et al. ..... 171/65 R
5,637,021 A 6/1997 Watanabe ..... 440/77
6,034,326 A * 3/2000 Jorgensen ..... 174/65 R
6,035,830 A * 3/2000 Saito ..... 123/457
6,082,782 A * 7/2000 Bartholoma et al. ..... 285/140.1
6,183,322 B1 2/2001 Takahashi ..... 440/76
6,257,940 B1 7/2001 Dunham et al. ..... 440/77
6,364,724 B1 4/2002 Nozawa et al. ..... 440/77

* cited by examiner

*Primary Examiner*—Ed Swinehart
(74) *Attorney, Agent, or Firm*—William D. Lanyi

(57) ABSTRACT

A rigging apparatus is provided for an outboard motor in which an attachment member is shaped to be rigidly attached to a housing structure, or cowl, of an outboard motor, without the need for additional hardware such as clamps, brackets, or screws. The attachment member is shaped to receive a threaded sleeve in threaded association therewith so that hoses, wires, and cables can be protected within the threaded sleeve. An attachment member of the rigging apparatus is made to be asymmetrical to avoid improper assembly into an opening of the housing structure of an outboard motor.

6 Claims, 6 Drawing Sheets

RIGGING APPARATUS FOR AN OUTBOARD MOTOR

BACKGROUND OF THE INVENTION

1. Field of the Invention

The present invention is generally related to a rigging apparatus for an outboard motor and, more particularly, to a device that is partially insertable into an opening in a housing structure of the outboard motor to control the position of several types of conduits, cables, and electrical connecting wires.

2. Description of the Prior Art

Those skilled in the art of outboard motors are familiar with many different techniques and devices used to assist in rigging the outboard motor.

U.S. Pat. No. 4,969,847, which issued to Curtis et al. on Nov. 13, 1990, discloses a through-cowl strain relief assembly for an outboard motor. It is intended to relieve strain on wires, cables, lines or the like which extend between the cowl assembly of an outboard motor and the boat with which the outboard motor is used. The strain relief assembly is preferably disposed within an opening formed in one of the cowl sections and comprises a two-piece member.

U.S. Pat. No. 5,637,021, which issued to Watanabe on Jun. 10, 1997, describes a control for an outboard motor. Embodiments of restraining grommets for use with protective cowling of marine outboard drives are described. The restraining grommet is formed with at least two openings made up of multi-part sections and at least one of which is slitted so as to permit ease of insertion and removal of the flexible element without kinking of them.

U.S. Pat. No. 6,183,322, which issued to Takahashi on Feb. 6, 2001, describes an operation cable mounting structure for an outboard motor. The outboard motor is provided with an engine covered by an engine cover composed of a plurality of cover elements and formed with a port member having a cable insertion port through which operation cables are guided inside an outboard motor and an operation cable mounting structure is formed to the outboard motor.

U.S. Pat. No. 6,257,940, which issued to Dunham et al. on Jul. 10, 2001, describes an outboard motor with centralized rigging. The outboard motor includes a propulsion unit having a powerhead which includes an internal combustion engine, a lower unit including a drive shaft housing fixed to the engine and a propeller shaft joined by the lower unit driven by the engine and having thereon a propeller. A cowling extends over the engine downwardly to the drive shaft housing defining an enclosed space containing the engine.

U.S. Pat. No. 6,364,724, which issued to Nozawa et al. on Apr. 2, 2002, describes a grommet assembly for an outboard motor. The assembly includes a grommet having a step, a flexible sleeve having a step and a connector configured to engage the step on the grommet and the step on the flexible sleeve. Preferably, the connector is in the form of an annular connector formed of two semicircular members connected to one another.

The patents described above are hereby expressly incorporated by reference in the description of the present invention.

SUMMARY OF THE INVENTION

A rigging apparatus for an outboard motor made in accordance with a preferred embodiment of the present invention comprises an attachment member having an insertable portion which is shaped to be received in an opening formed in a housing structure of the outboard motor. An internal surface of the attachment member can be threaded to accept a threaded sleeve.

The attachment member can comprise a first segment and a second segment, wherein the first and second segments are spaced apart from each other and movable relative to each other as a function of flexing of the attachment member. The insertable portion can have a shape defined by a major axis and a minor axis wherein the insertable portion is asymmetrical about the major axis.

The rigging apparatus can further comprise a protuberance extending outward from the insertable portion. The protuberance is integral with the insertable portion and can include two tabs shaped to lock the attachment member to the housing structure of an outboard motor when the insertable portion is disposed within the opening formed in the housing structure. The internal surface of the attachment member is formed as two surface segments of a cylindrical surface in a preferred embodiment of the present invention. The two surface segments can be spaced apart with each of the two surface segments being shaped to define parts of a thread pattern which are positioned to accept the threaded sleeve in threaded engagement therewith.

A preferred embodiment of the present invention can further comprise an elastomeric member which is shaped to be received within the internal surface of the attachment member. The elastomeric member can be shaped to comprise at least one hole extending therethrough in a direction which is generally parallel to a central axis of the cylindrical surface.

In a preferred embodiment of the present invention, it can further comprise a threaded sleeve which is attached to the attachment member in threaded relation therewith. It can also comprise a bezel of the attachment member connected to the insertable portion. The bezel is shaped to remain outside of the housing structure of an outboard motor when the insertable portion is inserted completely into the opening. The bezel can be shaped to move into contact with the housing structure when the insertable portion is inserted completely into the opening. The attachment member can be shaped to remain rigidly attached to the housing structure and to the threaded sleeve solely as a result of the shape of the attachment member.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
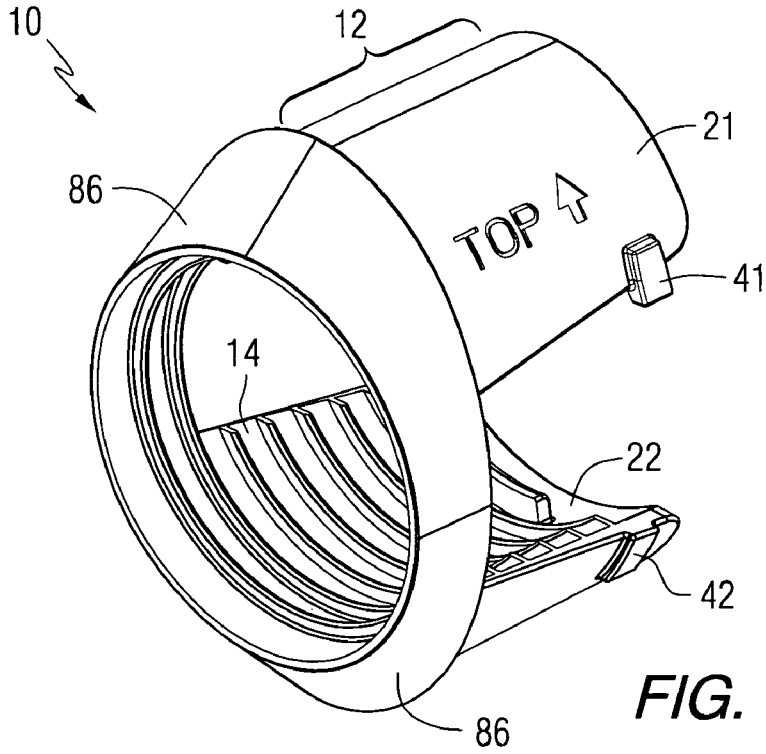
FIG. 1 is an isometric view of an attachment member of the present invention.

Throughout the description of the preferred embodiment of the present invention, like components will be identified by like reference numerals.

With reference to FIG. 1, a rigging apparatus for an outboard motor, made in accordance with a preferred embodiment of the present invention, comprises an attachment member 10 which has an insertable portion 12 that is shaped to be received in an opening formed in a housing structure of an outboard motor. An internal surface 14 of the attachment member 10 is threaded to accept a threaded sleeve in threaded relation therewith. The attachment member 10 comprises a first segment 21 and a second segment 22. The first and second segments, 21 and 22, are spaced apart from each other and movable relative to each other as a function of flexing of the attachment member 10.

Figure 2:
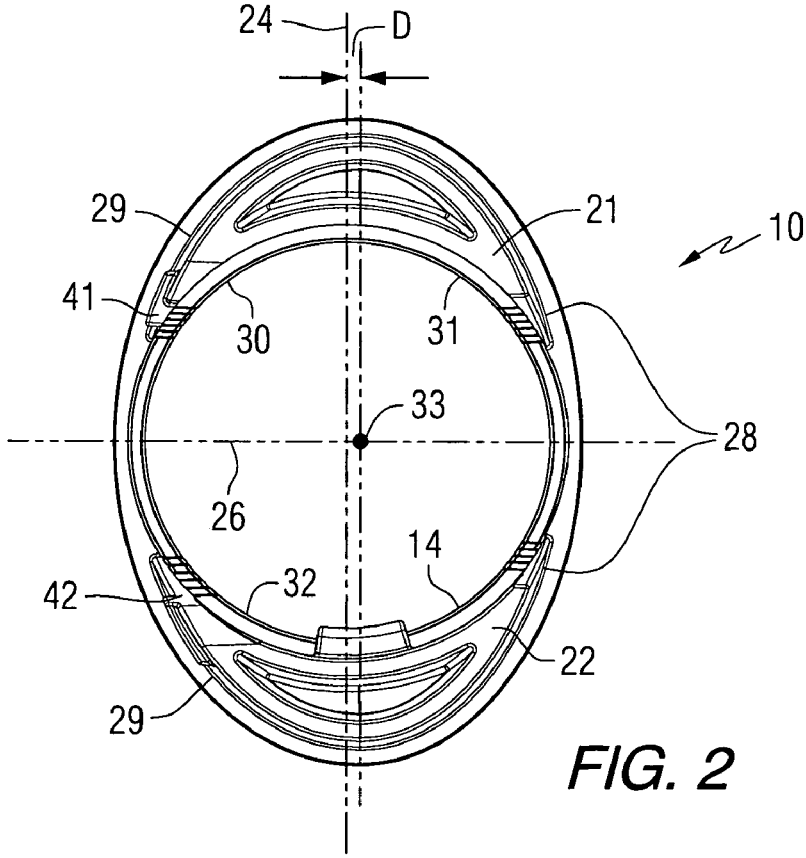
FIG. 2 is an end view of the attachment member of the present invention.

FIG. 2 shows an end view of the attachment member 10. The insertable portion 12 of the attachment member 10 is defined by a major axis 24 and a minor axis 26. The insertable portion 12 is asymmetrical about the major axis 24. In a particularly preferred embodiment of the present invention, the radius of curvature of surfaces on a first side of the structure is approximately 36.0 millimeters. The surfaces on that side of the structure are identified by reference numeral 28. On a second side of the attachment member 10, the radius of curvature is approximately 32.0 millimeters. These surfaces are identified by reference numeral 29.

The internal surface 14 of the attachment member 10 is formed as two surface segments. A first surface segment 31 is associated with the first segment 21 and a second surface segment 32 is associated with the second segment 22. These two surface segments are segments of an effective cylindrical surface 30 which, as described above, is threaded. The effective cylindrical surface 30 has a diameter of approximately 64 millimeters with a center, at point 33, which is offset from the major axis 24 by approximately 2 millimeters in a preferred embodiment. This offset is identified by reference letter D in FIG. 2.

With continued reference to FIGS. 1 and 2, at least one protuberance, identified by reference numerals 41 and 42, extends outwardly from the insertable portion 12. The protuberance is integral with the insertable portion 12 and shaped to lock the attachment member 10 to the housing structure of the outboard motor when the insertable portion 10 is disposed within the opening formed in the housing structure.

Figure 3:
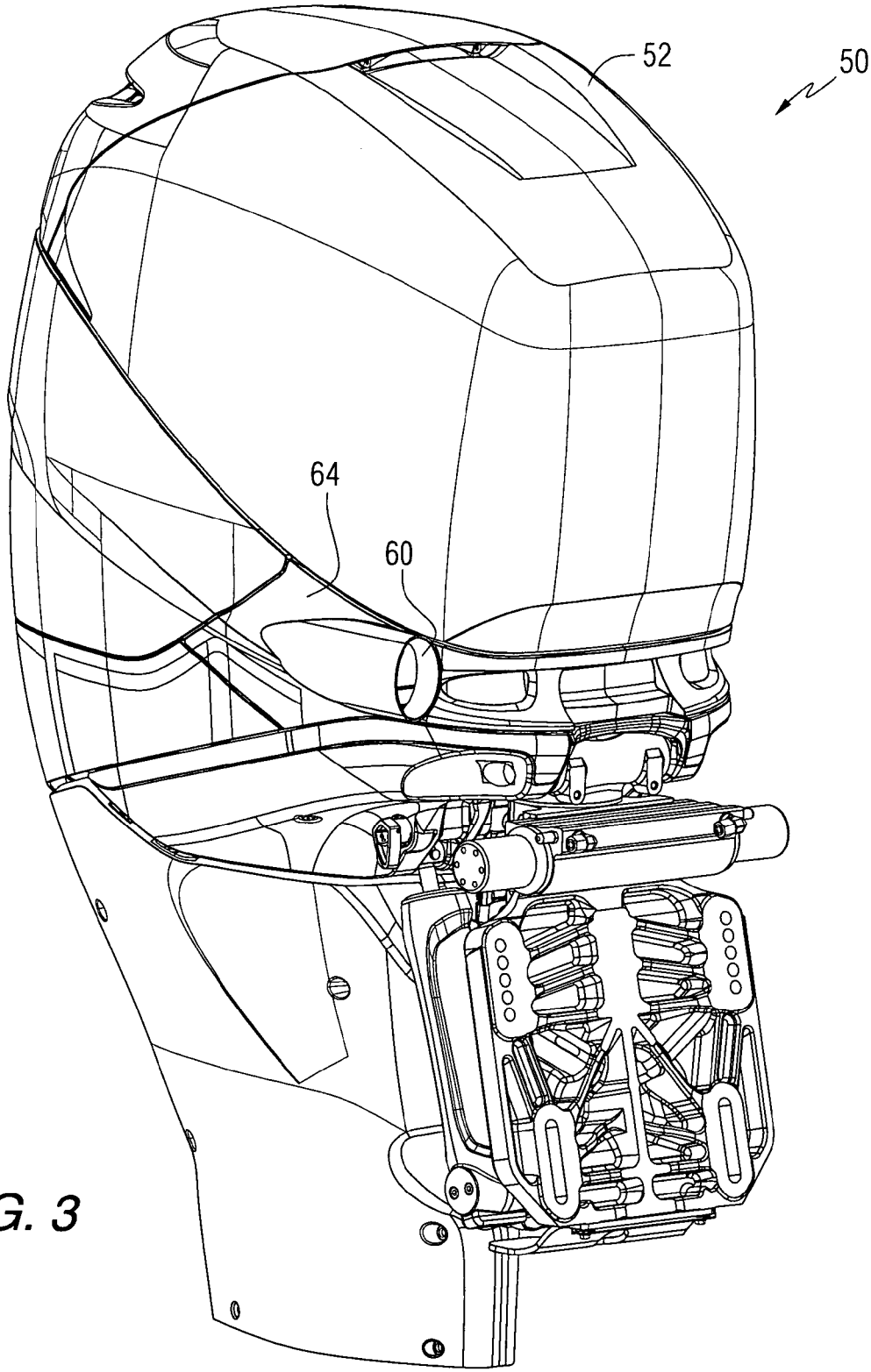
FIG. 3 shows an outboard motor with which the present invention is particularly suitable for use.

FIG. 3 shows an outboard motor with which the present invention can be used to provide a rigging apparatus that does not require additional hardware to attach the rigging apparatus to the housing structure, or cowl, of the outboard motor 50. The cowl 52 is provided with an opening 60 that is shaped to receive the insertable portion 12 of the attachment member 10 in locking association therein. The opening 60 is formed as an integral part of a section 64 of the housing structure.

Figure 4:
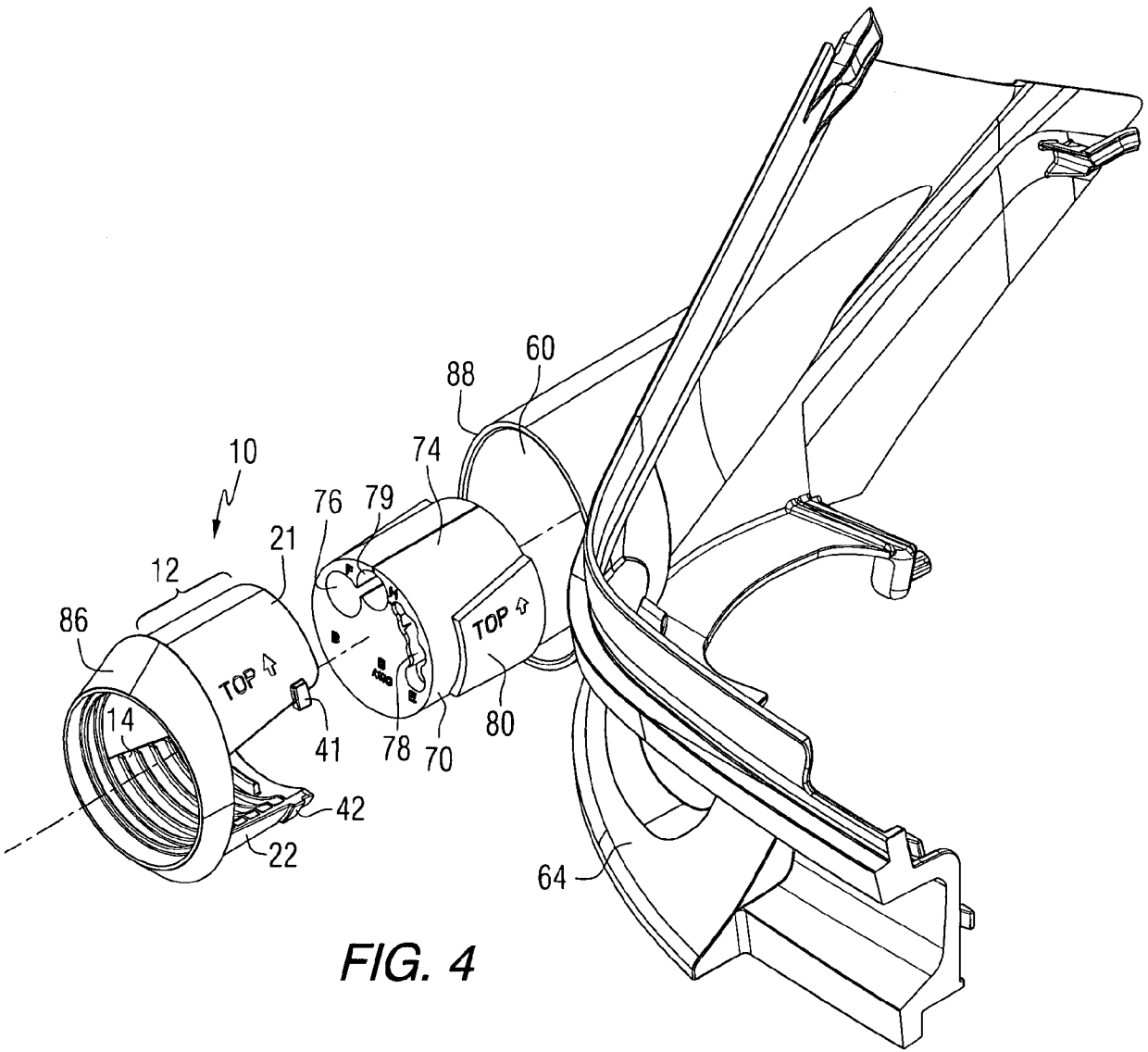
FIG. 4 is an exploded isometric view of one embodiment of the present invention.

FIG. 4 shows the section 64 of the housing structure 50 and the opening 60 which is formed as an integral part of the portion 64 of the cowl. In the exploded view of FIG. 4, the attachment member 10 is shown spaced apart from the opening 60, but it should be understood that the insertable portion 12 of the attachment member 10 is shaped to be inserted into the opening 60. In addition, the protuberance structure, 41 and 42, locks the attachment member 10 in place when it is pushed into the opening 60.

FIG. 4 shows one of the embodiments of the present invention. An elastomeric member 70 is shaped to be received within the internal surface 14 of the attachment member 10. Although the internal surface 14 is threaded for the purposes described above, the threaded surface is not required in all embodiments of the present invention. When the attachment member 10 is used in conjunction with an elastomeric member 70, the threads on the internal surface 14 provide discontinuities which assist in holding the elastomeric member 70 in place, but they are not required to be in the form of threads when used in this way. The elastomeric member 70, when used in the embodiment shown in FIG. 4, is first inserted into the inner portion of a woven sheath. The woven sheath, which is generally known to those skilled in the art and available in commercial quantities from numeral sources, is typically made of synthetic fibers which are woven to form a cloth conduit, or sheath, in which various hoses, cables, and wires can be disposed through the central opening of the sheath so that these various hoses, conduits, cables and wires are protected from abrasion by the presence of the woven sheath surrounding them. This woven sheath, not illustrated in FIG. 4, is disposed around the outside surface 74 of the elastomeric member 70 and also around the hoses, cables, and wires which extend through the various holes (e.g. those identified by reference numeral 76, 78, and 79 in FIG. 4). With the hoses, cables, and wires disposed through these holes formed in the elastomeric member 70 and with the woven sheath disposed around the cables, wires, and hoses, the woven sheath is extended over the outer surface 74 of the elastomeric member 70. The elastomeric member 70 is then inserted into the central portion of the attachment member 10. The threads on the internal surface 14 help to maintain the position of the elastomeric member 70 relative to the attachment member 10. In addition, two protrusions 80 are formed as a part of the elastomeric member 70 and are shaped to be received in the gaps between the first and second segments, 21 and 22. Although only one protrusion 80 is illustrated in FIG. 4, it should be understood that another protrusion is formed on the opposite side of the elastomeric member 70. These two protrusions are not identical in size, but are generally similarly shaped. They are each specifically shaped to be received in the associated gaps which are located on both sides of the attachment member 10 between the first and second segments, 21 and 22. Since the attachment member 10 is asymmetrical, as described above in conjunction with FIG. 2, the gaps are not identical in shape. Therefore, the differently shaped protrusions 80 are formed to be received in their associated gaps and are not generally interchangeable. As a result, the elastomeric member 70 is properly received within the attachment member 10 in only one position. An additional protrusion 83 is provided as an integral part of the attachment member 10 (shown in FIGS. 6 and 7) to further contain the elastomeric member 70 within the attachment member 10.

With continued reference to FIG. 4, the attachment member 10 is then inserted into the opening 60 and pushed until the bezel 86 moves into contact with the outer edge 88 of the opening 60. When this occurs, the protuberances, 41 and 42, snap into place and rigidly attach the attachment member 10 to the housing structure with the woven sheath captured between surfaces 74 and 14.

Figure 5:
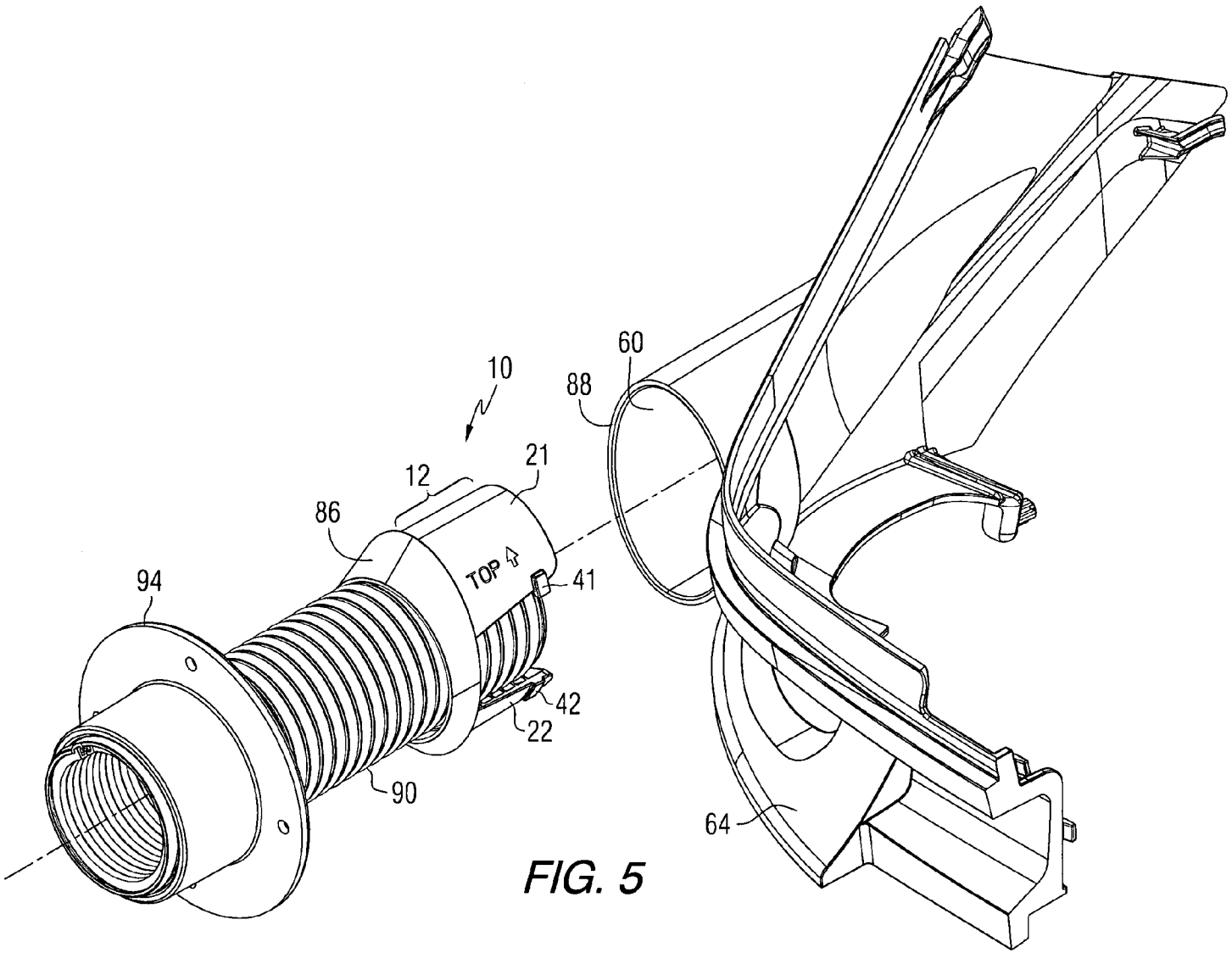
FIG. 5 is an exploded isometric view of a different embodiment of the present invention than the one shown in FIG. 4.

FIG. 5 shows an embodiment of the present invention in which a threaded sleeve 90 is attached to the attachment member 10 in threaded relation therewith. The threads formed as a portion of the outer surface of the threaded sleeve 90 are attached to the threads on the internal surface 14. As described above, the two surface segments of the first and second segments, 21 and 22, are threaded and combined to define a portion of a threaded cylindrical surface. The thread pitch is specifically selected to receive the threads of the threaded sleeve 90.

In the embodiment shown in FIG. 5, the elastomeric member 70 is not used. Instead, the cables, conduits, hoses, and wires extend through the opening 60, through the central portion of the attachment member 10, and through the internal cavity of the threaded sleeve 90. Although not a required part of the preferred embodiment of the present invention, an attachment member 94 is also shaped to receive the threaded sleeve 90 in threaded association with its internal threads to allow the threaded sleeve 90 to be rigidly attached to a structural portion of a marine vessel. This provides an enclosed protection system that prevents the cables, hoses, and wires from being damaged as they extend from the opening 60 to an opening formed in a wall of a marine vessel.

The bezel 86 of the attachment member 10 is connected to the insertable portion 12 and is shaped to remain outside of the housing structure 64 when the insertable portion 12 is inserted completely into the opening 60. The bezel 86 moves into contact with the edge 88 of the housing structure when the insertable portion 12 is inserted completely into the opening 60.

Figure 6:
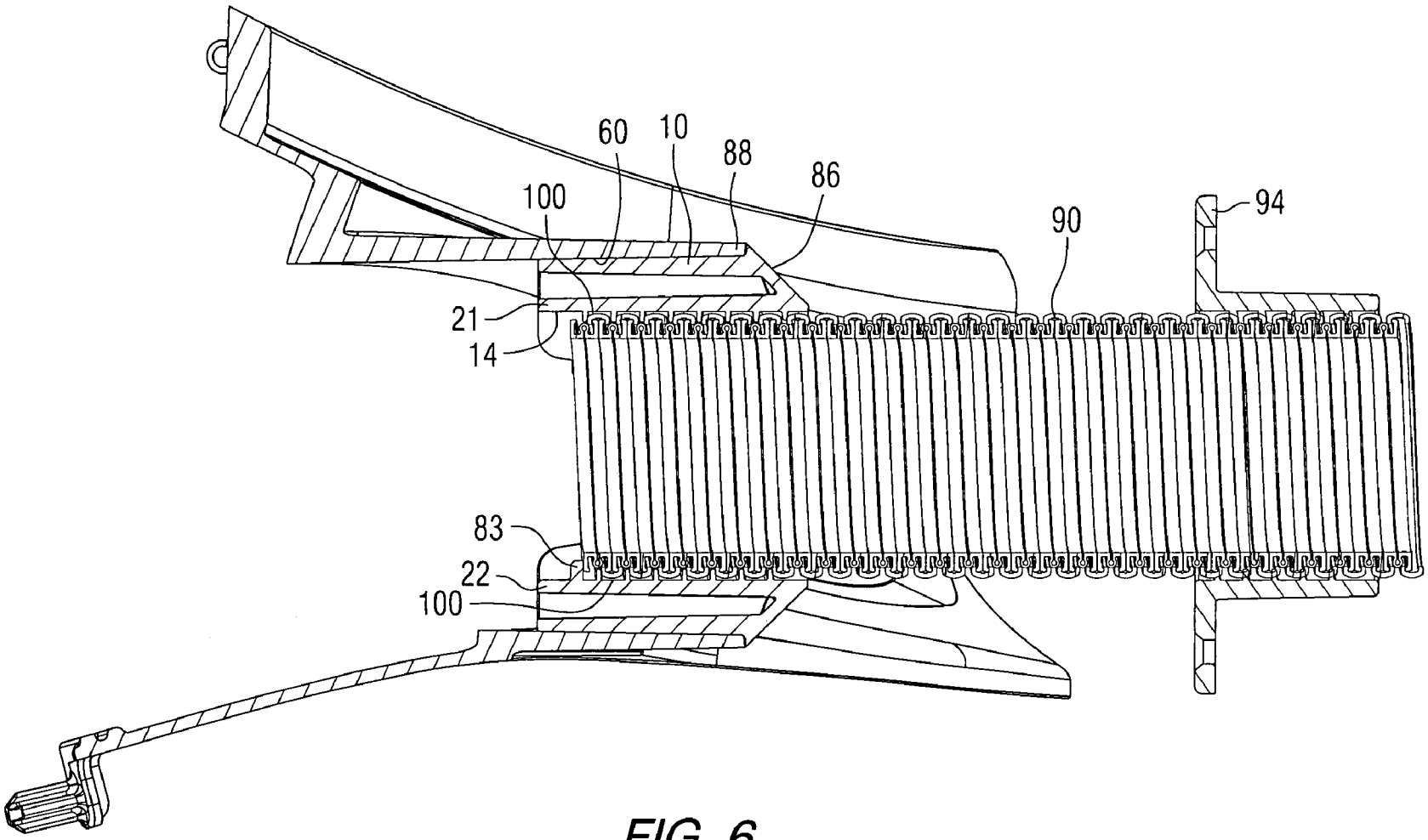
FIG. 6 is a section view of the present invention associated with a threaded sleeve and attached to a housing structure of an outboard motor.

FIG. 6 is a section view showing the threaded sleeve 90 disposed in threaded association with the internal surface 14 of the attachment member 10. The threads 100 are formed on the internal surface 14 on both of the surface segments, 31 and 32, of the first and second segments, 21 and 22, of the attachment member 10. The attachment member 10 is shown in FIG. 6 with its bezel 86 moved into contact with the outer edge 88 of the opening 60.

Figure 7:
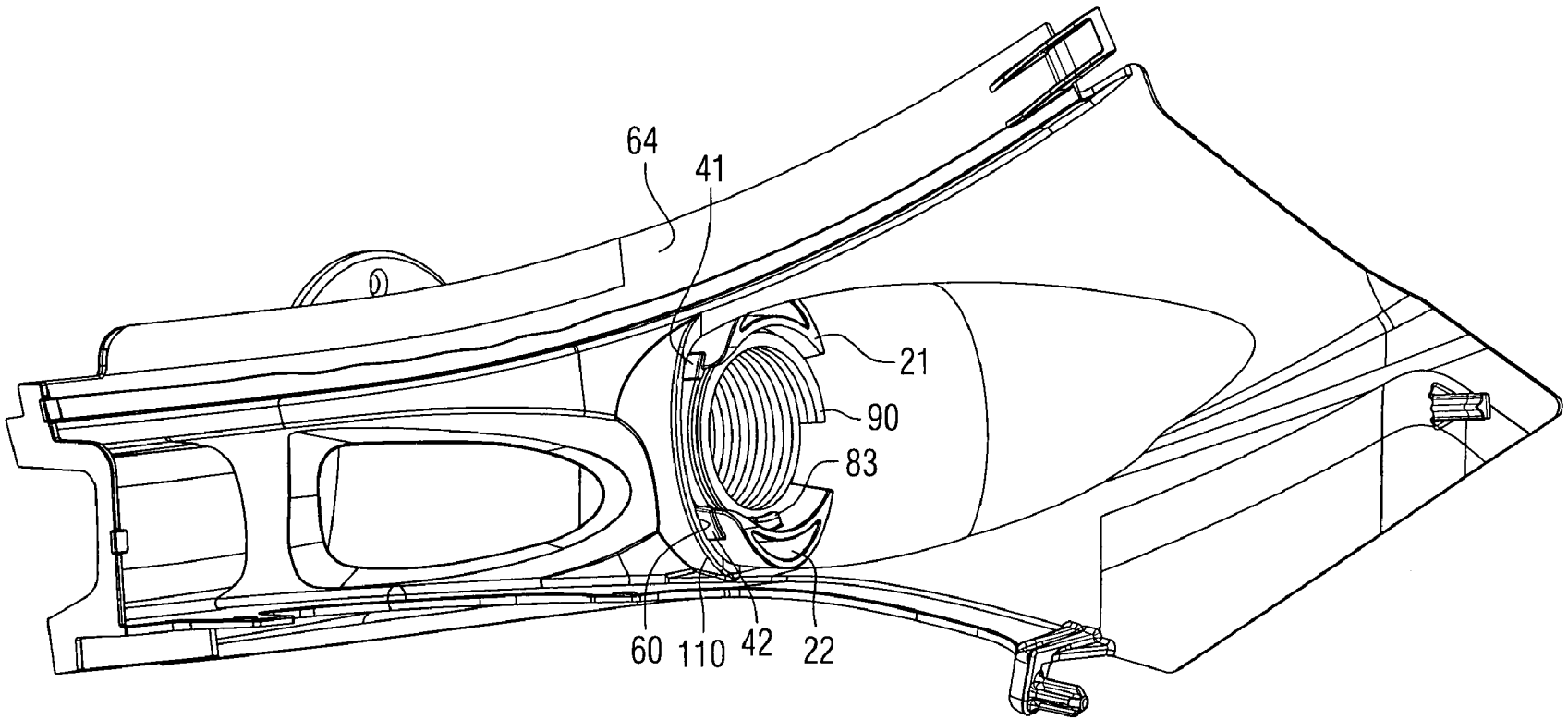
FIG. 7 is an internal isometric view showing the attachment mechanism by which the present invention is rigidly connected to the housing structure of an outboard motor without the use of additional hardware.

FIG. 7 is a partial view of the inside edge 110 of the opening 60. The protuberance, identified by reference numerals 41 and 42 in FIG. 7, are shown in their locking position after they snap over the inner edge 110 of the opening 60. Because of the structure of the attachment member 10, the insertable portion of the attachment member 10 is slightly compressed during insertion, along its major axis, because the protuberance is slightly larger than the internal surface of the opening 60. When the protuberance, identified by reference numerals 41 and 42, passes the inner edge 110, the resilience of the attachment member 10 causes the first and second segments, 21 and 22, to move apart toward their unstressed position. The protuberance then snaps into position, as shown in FIG. 7, and locks the attachment member 10 in place relative to the inner edge 110. As a result, no additional hardware items, such as hose clamps, screws, or bolts, are needed to rigidly maintain the position of the attachment member 10 in relation to the housing structure of the outboard motor. This is a result of the fact that the attachment member 10 is intentionally shaped to remain rigidly attached to the housing structure and to the threaded sleeve 90 solely as a result of the shape of the attachment member. In addition, the asymmetry of the attachment member 10 inhibits its improper insertion into the opening 60. If an attempt is made to insert the attachment member 10 into the opening 60 while in an improper position relative to the housing structure, the asymmetry of the insertable portion 12 and the matching asymmetry of the opening 60 combine to make this attempted improper insertion more difficult than it normally would be if the attachment member 10 was properly positioned prior to the insertion.

With reference to FIGS. 1–7, it can be seen that a rigging apparatus for an outboard motor, made in accordance with preferred embodiments of the present invention, comprises an attachment member 10 having an insertable portion 12 which is shaped to be received in an opening 60 formed in a housing structure, such as portion 64, of an outboard motor 50. The attachment member 10 comprises a first segment 21 and a second segment 22. The first and second segments are spaced apart from each other and movable relative to each other as a function of flexing of the attachment member 10. The insertable portion 12 has a shape defined by a major axis 24 and a minor axis 26. The insertable portion 12 is asymmetrical about the major axis 24. The internal surface 14 of the attachment member comprises a first surface segment 31 on the first segment 21 and a second surface segment 32 on the second segment 22. The first and second surface segments are each a partial segment of an effective cylindrical surface 30. The two surface segments, 31 and 32, are spaced apart from each other along the major axis 24 and are shaped to define parts of a thread pattern 100 which is positioned to accept the threaded sleeve 90 in threaded engagement therewith. A protuberance, identified by reference numerals 41 and 42, extends outwardly from the insertable portion 12. The protuberance is integral with the insertable portion 12 and shaped to lock the attachment member 10 to the housing structure 64 when the insertable portion 12 is disposed within the opening 60 that is formed in the housing structure. In certain embodiments of the present invention, an elastomeric member 70 is shaped to be received within the internal surface 14 of the attachment member 10. A woven sheath (not shown in the figures) is partially disposed between the elastomeric member 70 and the attachment member 10. The elastomeric member 70 is shaped to comprise at least one hole (identified by reference numerals 76, 78, and 79) which extend therethrough in a direction which is generally parallel to a central axis of the cylindrical surface 74 of the elastomeric member 70. The threaded sleeve 90 is attached, in a preferred embodiment of the present invention, to the attachment member 10 in threaded relation therewith. A bezel 86 of the attachment member 10 is connected to the insertable portion 12 in a preferred embodiment and the bezel 86 is shaped to remain outside of the housing structure 64 when the insertable portion 12 is inserted completely into the opening 60. The bezel 86 is shaped to move into contact with an edge 88 of the housing structure 64 when the insertable portion 12 is inserted completely into the opening 60. The attachment member 10 is shaped to remain rigidly attached to the housing structure 64 and to the threaded sleeve 90 solely as a result of the shape of the attachment member 10.

Although the present invention has been described in conjunction with specific embodiments of the present invention, it should be understood that alternative embodiments are also within its scope.

We claim:

1. A rigging apparatus for an outboard motor comprising an attachment member having an insertable portion shaped to be received in an opening formed in a housing structure of said outboard motor, an internal surface of said attachment member accepting a sleeve in gripped relation therewith, wherein said sleeve extends along a longitudinal axis extending through said attachment member into said opening, said insertable portion being received in said opening in push-in insertion mounted relation axially along said longitudinal axis, wherein said insertable portion has an outer peripheral shape defined by a major lateral axis and a minor lateral axis, said outer perimeteral shape of said insertable portion being asymmetric about said major lateral axis to provide singular position push-in insertion mounting of said insertable portion along said longitudinal axis into said opening, whereby to inhibit improper insertion mounting of said attachment member.

2. The rigging apparatus according to claim 1 wherein said attachment member remains rigidly attached in said opening solely by said outer perimeteral shape.

3. The rigging apparatus according to claim 1 wherein said insertable portion is compressed along said major lateral axis during push-in insertion mounting.

4. A rigging apparatus for an outboard motor comprising an attachment member having an insertable portion shaped to be received in an opening formed in a housing structure of said outboard motor, an internal surface of said attachment member accepting a sleeve in gripped relation therewith, wherein said sleeve extends along a longitudinal axis extending through said attachment member into said opening, said insertable portion being received in said opening in push-in insertion mounted relation axially along said longitudinal axis, wherein said attachment member has an exterior section exterior of said housing structure, and has an interior section interior of said housing structure, said interior section comprising a pair of leg segments extending longitudinally from said exterior section, said leg segments being laterally separated by a pair of non-identically shaped lateral gaps.

5. The rigging apparatus according to claim 4 wherein said insertable portion has an outer perimeteral shape defined by said pair of leg segments and said pair of lateral gaps therebetween, said outer perimeteral shape having a major lateral axis and a minor lateral axis, said outer perimeteral shape being asymmetric about said major lateral axis.

6. A rigging apparatus for an outboard motor comprising an attachment member having an insertable portion shaped to be received in an opening formed in a housing structure of said outboard motor, an internal surface of said attachment member accepting a sleeve in gripped relation therewith, wherein said sleeve extends along a longitudinal axis extending through said attachment member into said opening, said insertable portion being received in said opening in push-in insertion mounted relation axially along said longitudinal axis, wherein said attachment member has an exterior section exterior of said housing structure, and has an interior section interior of said housing structure, said interior section comprising a pair of leg segments extending longitudinally from said exterior section, each leg segment having a root end at said exterior section and extending longitudinally therefrom into said housing structure, said pair of leg segments being laterally spaced apart from each other, and comprising an elastomeric member received laterally between said leg segments, wherein said leg segments are laterally separated by a pair of non-identically shaped lateral gaps, and wherein said elastomeric member has differently shaped protrusions received in said gaps for non-interchangeability, such that said elastomeric member is received within said attachment member between said leg segments in only one position.

* * * * *